US007188597B2

(12) United States Patent
Rodriguez et al.

(10) Patent No.: US 7,188,597 B2
(45) Date of Patent: Mar. 13, 2007

(54) ENGINE COLD START AID MALFUNCTION ALERT

(75) Inventors: Rogelio Rodriguez, Plainfield, IL (US); Adam C. Lack, Willow Springs, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 35 days.

(21) Appl. No.: 11/147,550

(22) Filed: Jun. 7, 2005

(65) Prior Publication Data

US 2006/0272606 A1 Dec. 7, 2006

(51) Int. Cl.
*F02P 19/02* (2006.01)

(52) U.S. Cl. ..... 123/179.6; 123/145 A

(58) Field of Classification Search ..... 123/145 A, 123/179.21, 179.6; 219/497; 701/102
See application file for complete search history.

(56) References Cited

U.S. PATENT DOCUMENTS 4,307,688 A * 12/1981 Steele ..... 123/179.6
4,500,775 A * 2/1985 Sangu et al. ..... 219/497
4,606,306 A 8/1986 Caron et al.
4,862,370 A * 8/1989 Arnold et al. ..... 123/145 A
5,121,324 A * 6/1992 Rini et al. ..... 701/105
5,241,929 A 9/1993 Grassi et al.
5,327,870 A * 7/1994 Boisvert et al. ..... 123/145 A
5,482,013 A * 1/1996 Andrews et al. ..... 123/179.21
5,570,666 A * 11/1996 Rymut et al. ..... 123/145 A
5,729,456 A * 3/1998 Boisvert et al. ..... 123/179.21
6,009,369 A * 12/1999 Boisvert et al. ..... 123/145 A
6,148,258 A * 11/2000 Boisvert et al. ..... 123/145 A
6,164,258 A * 12/2000 Petrovich et al. ..... 123/179.6
6,186,107 B1 2/2001 Navalon Carretero

* cited by examiner

*Primary Examiner*—T. M. Argenbright
(74) *Attorney, Agent, or Firm*—Susan L. Lukasik; Elias P. Soupos; Jeffrey P. Calfa

(57) ABSTRACT

A motor vehicle engine (10) has a glow plug system (14) for aiding combustion of fuel in combustion chambers of the engine when the engine is cold and an ignition switch (16) is operated to crank the engine. A first circuit signals the cold start aid to commence operation of the cold start aid in anticipation of engine starting. A second circuit indicates a fault in the cold start aid. A third circuit, that includes a warning signal device (38), activates the warning signal device to inform a driver of the vehicle of the indicated fault upon the first circuit having signaled the cold start aid to commence operation and the second circuit having indicated a fault in the cold start aid.

17 Claims, 1 Drawing Sheet

PP_ELC_GPL_EN/ELC_GPL_MODE_LEGEND 0 (ELSE) = ELC LAMP SOFTWARE/FEATURE DISABLED

1 = SOFTWARE ENABLED WITHOUT OUTPUT SIGNAL

2 = SOFTWARE ENABLED WITH OUTPUT SIGNAL

3 = SOFTWARE ENABLED WITH OUTPUT SIGNAL DIAGNOSTIC ACTIVE

ENGINE COLD START AID MALFUNCTION ALERT

FIELD OF THE INVENTION

This invention relates to motor vehicles powered by combustion engines, especially diesel engines, that have cold start aids, such as glow plugs, for aiding engine starting in cold weather. More specifically the invention relates to a system for alerting the driver to an indicated malfunction, or fault, in the cold start aid system with the intent that the driver, after having been alerted, will not crank the engine until the issue has been favorably resolved, thereby avoiding potentially draining the vehicle battery or batteries before the engine has started and begun to run under its own power.

BACKGROUND OF THE INVENTION

Diesel engines in certain motor vehicles often use a starting aid, particularly when engine starting is attempted in cold weather. The starting aid is employed until sufficient heat has been developed in the combustion chambers for assured combustion of injected diesel fuel by compression ignition.

Known cold start aids include ether injection, block heating, and glow plugs. Ether injection introduces into the combustion chambers a gas (ether) that is highly combustible and effective to aid fuel ignition even at low temperatures. The use of ether requires an on-board supply that eventually needs to be replenished, and installation of an ether system adds to the engine cost.

Glow plugs are electrically energized to heat the combustion chambers to aid combustion of injected diesel fuel. The glow plugs may continue to be energized during initial running of the engine until desired operating temperature has been reached.

A glow plug starting aid system typically has one or more glow plugs associated with each combustion chamber, and some form of controller or control system that controls the delivery of electric current to the glow plugs from the vehicle battery or battery bank. The controller may comprise one or more relays through which battery current is conducted to the glow plugs.

When a cold engine is to be started, the one or more relays operate one or more contacts that connect the glow plugs to the battery, with the electric current acting to heat the glow plugs which in turn heat the combustion chambers. During combustion chamber heating the relays may be intermittently cycled off by the controller so that the current is intermittently delivered to the glow plugs. The engine is thereafter cranked until it starts and begins running under its own power, and the relays may continue to be operated as the engine warms up.

Failure of a cold start aid to start the engine may be due to various causes including ones other than in the cold start aid itself. In cold weather, a fault in the cold start aid may be sufficient by itself however to render the engine incapable of being successfully started. Cold weather also strains the battery or batteries that are used to crank the engine via the starter motor. A driver of a motor vehicle who is attempting to start a diesel engine in cold weather may continue cranking the engine in expectation of its eventual starting. But excessive cranking will drain the battery or batteries and render them incapable of further cranking. At that point, the vehicle requires service personnel and equipment to come to its aid, often resulting in the vehicle having to be towed to a service facility.

SUMMARY OF THE INVENTION

It would be desirable if situations that lead to such cold weather battery draining could be avoided, and it is toward that end that the present invention is directed.

The inventors believe that if the driver could be made aware of a possible fault in a cold start aid, especially a glow plug start aid system, in a timely fashion when using the cold start aid to start the engine, he or she would not crank the engine to the point of draining the battery or batteries. While that would not necessarily cure the fault itself, it would conserve electrical power that may be especially valuable when the vehicle is at a remote location, and it would avoid stressing the batteries, and adverse consequences on battery life and battery performance resulting from such stress.

If an engine is equipped not only with glow plugs, but also with an additional cold start aid system such as ether injection or block heating, those alternate means could be promptly used instead of the glow plugs upon the driver being informed of an indicated fault in the glow plug system.

The present invention relates in one respect to a system for indicating a fault in the glow plug system to the driver so that excessive cranking that may drain the battery or batteries can be avoided.

One generic aspect of the present invention comprises a motor vehicle comprising an internal combustion engine that has a cold start aid for aiding combustion of fuel in combustion chambers of the engine when the engine is cold and the ignition switch is operated to start the engine. A first circuit signals the cold start aid to commence operation of the cold start aid in anticipation of engine cranking. A second circuit indicates a fault in the cold start aid. A third circuit, that includes a warning signal device, activates the warning signal device to inform a driver of the vehicle of the indicated fault upon the first circuit having signaled the cold start aid to commence operation and the second circuit having indicated a fault in the cold start aid.

Another generic aspect comprises a method for informing a driver of a motor vehicle of an indicated fault in a cold start aid for starting an internal combustion engine that propels the vehicle so that the driver can avoid draining one or more batteries that crank the engine during cold starting because of the indicated fault. The method comprises: after the driver has operated an ignition switch from an OFF position to an ON position, signaling the cold start aid to commence operation; signaling an indicated fault in the cold start aid; and upon both the cold start aid having been signaled to commence operation and an indicated fault in the cold start aid having been signaled, activating a warning device in the presence of the driver to inform the driver of the indicated fault.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
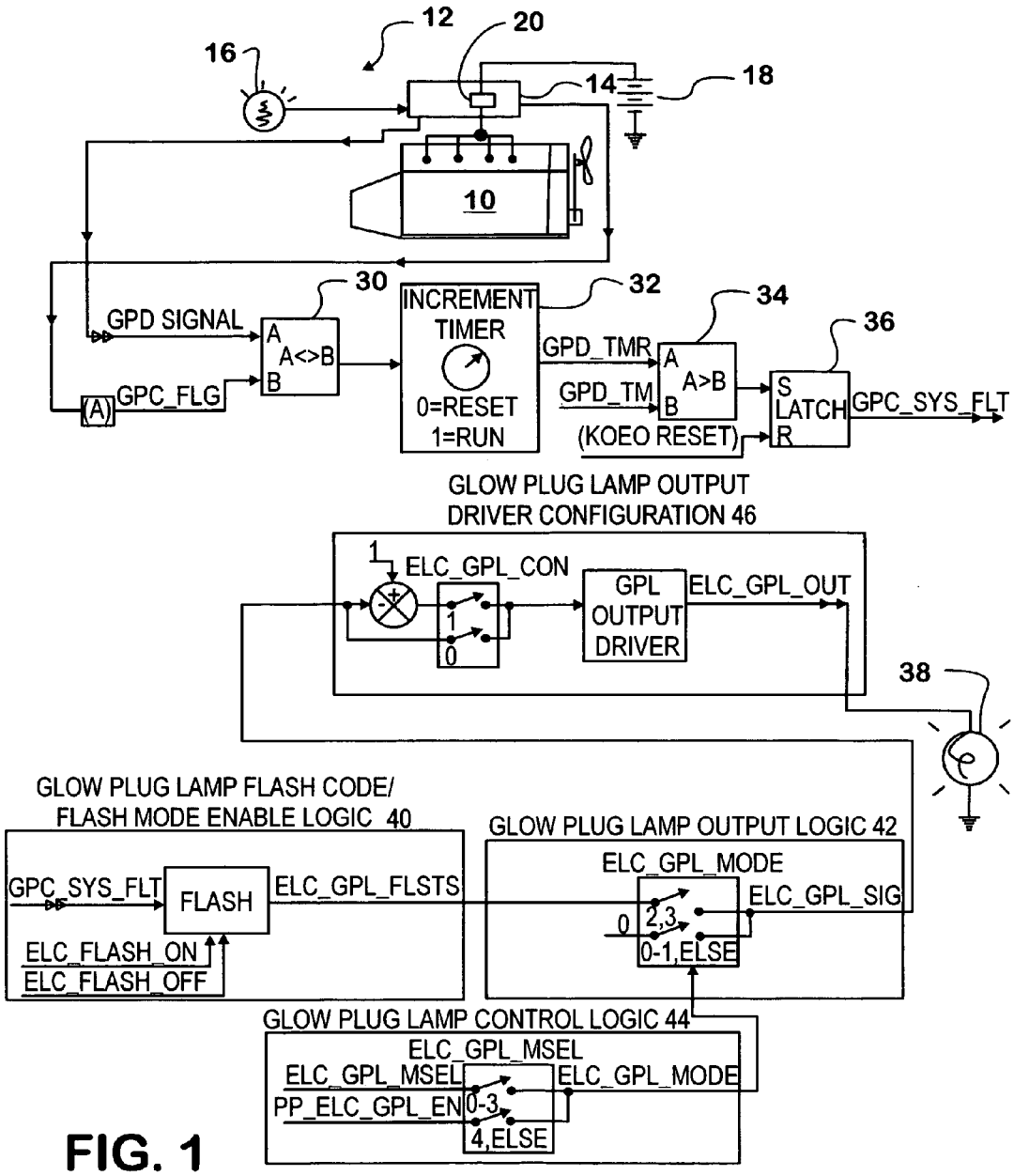
FIG. 1 is schematic diagram of portions of a motor vehicle engine and associated electrical system relevant to principles of the present invention.

FIG. 1 shows a diesel engine 10 in a motor vehicle and portions of an associated electrical system 12. An example of such a motor vehicle is a heavy truck where engine 10 comprises combustion chambers into which diesel fuel is injected by a fuel injection system to ignite under heat of compression and thereby run the engine to propel the vehicle.

To aid engine starting in cold weather, engine 10 includes a glow plug system 14 that has individual glow plugs associated with the combustion chambers. Glow plug system 14 comprises a glow plug controller that forms a part of electrical system 12, either by being integrated with the electrical system or as a separate unit that is connected into the electrical system.

An ignition switch 16 that is disposed in the cab of the vehicle for driver access functions to turn engine 10 on and off. The typical ignition switch requires a key to selectively operate the switch to ACCESSORY, OFF, IGNITION, and CRANK positions. The IGNITION position may sometimes be referred to as ON position. The key is typically inserted into the switch when the switch is in OFF position. Turning the inserted key one way from OFF position places the switch in ACCESSORY position. Turning the inserted key the other way from OFF position places the switch first in IGNITION, or ON, position. Turning the key still farther against a return spring places the switch in CRANK position for cranking engine 10 at starting.

One control input to glow plug system 14 is a circuit that signals that ignition switch 16 has been placed in ON position. While actual operation of the glow plug system may also depend on other control inputs, the glow plugs cannot be energized from the vehicle battery or batteries 18 unless ignition switch 16 is in ON position.

The controller of glow plug system 14 comprises one or more relays 20 through which battery current is delivered to the individual glow plugs. When ignition switch 16 is in ON position and system 14 has been signaled to commence operation, coils of relays 20 are energized from the battery or batteries causing contacts of the relays to close, thereby connecting the glow plugs to the battery or batteries. The battery current delivered to the glow plugs heats them with the heat being transferred to the combustion chambers.

After some amount of heating time, which may be determined by the controller and/or by the judgment of the driver, the engine can be fueled and cranked. Cranking occurs by the driver turning the ignition switch to CRANK position. With sufficient heating having been provided by the glow plug system, the engine should start without excessive cranking.

Certain failures in the glow plug system will not however result in sufficient heating, and hence repeated cranking will not be effective to start the engine. Excessive cranking without engine starting may in fact drain the battery or batteries to the point where they are incapable of further cranking.

A failure in a relay or relays 20 is the type of failure that can produce such an undesired outcome.

Early detection of such a failure and its prompt disclosure to the driver can enable the driver to avoid the excessive cranking that could otherwise drain the battery or batteries without successfully starting the engine.

FIG. 1 shows a further circuit from glow plug system 14 that provides a signal named GPD_Signal to indicate a failure in system 14, such as failure of a relay 20 to operate properly, when the glow plugs are to be heated. A still further circuit processes signal GPD_Signal and a signal named GPC_FLG. The latter signal may have a logic "1" value when the glow plugs are to be heated, otherwise a logic "0". Signal GPD_Signal may have a logic "1" value when a fault is indicated in glow plug system 14, such as failure of a relay 20 to properly operate when the glow plugs are to be heated, otherwise a logic "0".

The circuit that processes signal GPD_Signal and signal GPC_FLG comprises a compare function 30 that compares the two signals. When the glow plugs are to be heated, signal GPD_Signal changes from a logic "0" to a logic "1". If a relay 20 does not operate properly in response to the change in signal GPD_Signal, signal GPC_FLG does not change from a logic "1" to a logic "0", but instead remains a logic "1". Consequently, with both of its inputs logic "1's" compare function 30 starts a timer 32.

A further compare function 34 compares time elapsed on timer 32 (GPD_TMR) with a reference time GPD_TM. If timer 32 continues to run beyond the reference time, compare function 34 sets a latch function 36 to indicate a fault via a signal GPC_SYS_FLT.

Signal GPC_SYS_FLT is effective to begin flashing a warning lamp 38 disposed in the vehicle cab in a location where it should get the immediate attention of a vigilant driver. Upon seeing the flashing lamp, the driver should discontinue cranking the engine because of an indicated fault in the glow plug system.

Flashing of lamp 38 is performed by several elements in a control strategy including Glow Plug Lamp Flash Code/Flash Mode Enable Logic 40, Glow Plug Lamp Output Logic 42, Glow Plug Lamp Control Logic 44, and Glow Plug Lamp Output Driver Configuration 46. The control strategy enables the warning feature via the collective effect of Glow Plug Lamp Output Logic 42 and Glow Plug Lamp Control Logic 44.

Glow Plug Lamp Flash Code/Flash Mode Enable Logic 40 converts the signal GPL_FLG into an on-off signal for turning lamp 38 on and off to produce the flashing. Glow Plug Lamp Output Driver Configuration 46 adapts the logic of the on-off flashing signal to that of the particular lamp driver so that proper flashing occurs.

Once a fault has been indicated by signal GPC_SYS_FLT, the signal continues to be given until ignition switch 16 is turned to OFF position. This is because latch function 36 can be reset only when ignition switch 16 is in OFF position.

While a presently preferred embodiment of the invention has been illustrated and described, it should be appreciated that principles of the invention apply to all embodiments falling within the scope of the following claims.

What is claimed is:

1. A motor vehicle comprising:

an internal combustion engine that has a cold start aid for aiding combustion of fuel in combustion chambers of the engine when the engine is cold and an ignition switch is operated to start the engine;

a first circuit for signaling the cold start aid to commence operation in anticipation of engine cranking by operating a switching device through which electric current is conducted to operate the cold start aid;

a second circuit for indicating failure of the switching device to conduct electric current to the cold start aid after the first circuit has signaled for commencement of cold start aid operation; and a third circuit, including a warning signal device, for activating the warning signal device to inform a driver of the vehicle of an indicated failure upon the first circuit having signaled the cold start aid to commence operation and the second circuit having indicated failure of the switching device to conduct electric current to the cold start aid.

2. A motor vehicle as set forth in claim 1 wherein the ignition switch is selectively positionable to OFF, ON, and CRANK positions, and the first circuit requires that the ignition switch be in ON position in order to signal the cold start aid to commence operation.

3. A motor vehicle as set forth in claim 2 wherein the cold start aid comprises glow plugs that electrically heat the combustion chambers when the ignition switch is in ON position and the first circuit has signaled the cold start aid to commence operation.

4. A motor vehicle as set forth in claim 1 wherein the warning device comprises a visible indicator that illuminates when activated.

5. A motor vehicle as set forth in claim 1 wherein the warning device comprises a lamp that flashes on and off when activated.

6. A motor vehicle as set forth in claim 1 wherein the third circuit comprises a timer that starts upon the first circuit having signaled the cold start aid to commence operation and the second circuit having indicated a failure of the switching device to conduct electric current to the cold start aid after the first circuit has signaled for commencement of cold start aid operation, a comparator that compares the time elapsed on the timer with a reference time, and a detector that activates the warning device when the time elapsed on the timer corresponds to the reference time.

7. A motor vehicle as set forth in claim 6 wherein after having activated the warning device, the detector maintains the warning device activated until the ignition switch is operated to OFF position.

8. A method for informing a driver of a motor vehicle of an indicated failure of a switching device to conduct electric current for operating a cold start aid for starting an internal combustion engine that propels the vehicle so that the driver can avoid draining one or more batteries that crank the engine during cold starting because of the indicated failure, the method comprising:

after the driver has operated an ignition switch from an OFF position to an ON position, signaling the cold start aid to commence operation by signaling the switching device to conduct electric current to the cold start aid;

signaling an indicated failure of the switching device to conduct electric current to the cold start aid in response to signaling the switching device to conduct electric current to the cold start;

and upon both the switching device having been signaled to commence conducting current to the cold start aid and an indicated failure of the switching device having been signaled, activating a warning device in the presence of the driver to inform the driver of the indicated failure.

9. A method as Set forth in claim 8 wherein the step of activating a warning device comprises illuminating a visible indicator within the view of the driver.

10. A method as set forth in claim 8 wherein the step of activating a warning device comprises flashing a lamp within the view of the driver.

11. A method as set forth in claim 10 wherein the step of flashing a lamp within the view of the driver comprises continuing flashing of the lamp until the ignition switch is operated to OFF position.

12. A motor vehicle as set forth in claim 1 wherein the switching device comprises a relay having contacts that close to conduct electric current to the cold start aid.

13. A motor vehicle as set forth in claim 1 wherein the third circuit comprises a logic function that compares respective logic signals from the first and second circuits for activating the warning signal device when the logic signals disclose that the first circuit has signaled the cold start aid to commence operation and that the second circuit has indicated failure of the switching device to conduct electric current to the cold start aid in response to the first circuit having signaled the cold start aid to commence operation.

14. A method for informing a driver of a motor vehicle of an indicated failure of a relay to close contacts through which electric current is conducted to operate one or more glow plugs that aid starting of an internal combustion engine that propels the vehicle so that the driver can avoid draining one or more batteries that crank the engine during cold starting because of the indicated failure, the method comprising:

after the driver has operated an ignition switch from an OFF position to an ON position, signaling the relay to close the contacts and commence conducting electric current to the one or more glow plugs;

signaling an indicated failure of the relay to close the contacts in response to the signaling to the relay;

and upon both the relay having been signaled and an indicated failure having been signaled, activating a warning device in the presence of the driver to inform the driver of the indicated failure.

15. A method as set forth in claim 14 wherein the step of activating a warning device comprises illuminating a visible indicator within the view of the driver.

16. A method as set forth in claim 14 wherein the step of activating a warning device comprises flashing a lamp within the view of the driver.

17. A method as set forth in claim 16 wherein the step of flashing a lamp within the view of the driver comprises continuing flashing of the lamp until the ignition switch is operated to OFF position.

* * * * *